US008801379B2

(12) United States Patent
Allen et al.

(10) Patent No.: US 8,801,379 B2
(45) Date of Patent: Aug. 12, 2014

(54) WHEEL AND REPLACEABLE NOSE PIECE

(75) Inventors: John Frederick Allen, El Segundo, CA (US); Andrei Minculescu, Bucharest (RO); Sigismund Becze, Bucharest (RO); Jair Corpus, Mexicali (MX)

(73) Assignee: Honeywell International Inc., Morristown, NJ (US)

( * ) Notice: Subject to any disclaimer, the term of this patent is extended or adjusted under 35 U.S.C. 154(b) by 486 days.

(21) Appl. No.: 13/161,056

(22) Filed: Jun. 15, 2011

(65) Prior Publication Data

US 2012/0321458 A1 Dec. 20, 2012

(51) Int. Cl.
*F01D 5/10* (2006.01)

(52) U.S. Cl.
USPC ..... 416/144; 73/455

(58) Field of Classification Search
USPC ..... 416/144, 145, 244 A, 245 R; 73/455
See application file for complete search history.

(56) References Cited

U.S. PATENT DOCUMENTS

| | | | | |
|---|---|---|---|---|
| 2,602,683 | A * | 7/1952 | Aue | 416/244 A |
| 6,012,901 | A * | 1/2000 | Battig et al. | 416/244 A |
| 6,481,970 | B2 | 11/2002 | Mukherjee et al. | |
| 2005/0244249 | A1 * | 11/2005 | Sussenbach | 411/411 |

FOREIGN PATENT DOCUMENTS

| | | | |
|---|---|---|---|
| DE | 4444082 | A1 | 6/1996 |
| EP | 138516 | A1 | 4/1985 |
| EP | 1273757 | A1 | 1/2003 |
| EP | 1803941 | A1 | 7/2007 |
| GB | 2410992 | A | 8/2005 |
| WO | 2008151905 | A1 | 12/2008 |
| WO | 2010111133 | A2 | 9/2010 |

OTHER PUBLICATIONS

High-Speed (VSR) Core Balancing Machines, Turbo Technics Ltd, UK, Jul. 2010.
Introduction to the Principles of Turbocharger Core Balancing Using the Turbo Technics VSR, Turbo Technics Ltd., UK, Jul. 2010.
Examination Report Application No. 12 169 668.6, May 7, 2013 (8 pages).
European Search Report Applicaiton No. 12 169 668.6 (2535592), Apr. 16, 2013 (4 pages).

* cited by examiner

*Primary Examiner* — Richard Edgar
(74) *Attorney, Agent, or Firm* — Brian J. Pangrle

(57) ABSTRACT

An assembly includes a nose piece and a boreless compressor wheel having a nose end configured for receipt of the nose piece and a receptacle at a base end configured for receipt of a rotatable shaft. A method includes fitting a nose piece to a boreless compressor wheel, measuring unbalance and, based in part on the measuring, removing material from the nose piece. Various other examples of devices, assemblies, systems, methods, etc., are also disclosed.

20 Claims, 10 Drawing Sheets

WHEEL AND REPLACEABLE NOSE PIECE

TECHNICAL FIELD

Subject matter disclosed herein relates generally to turbomachinery for internal combustion engines and, in particular, to compressor wheels configured for receipt of a nose piece.

BACKGROUND

Exhaust driven turbochargers include a rotating group that includes a turbine wheel and a compressor wheel that are connected to one another by a shaft. The shaft is typically rotatably supported within a center housing by one or more bearings (e.g., oil lubricated, air bearings, ball bearings, magnetic bearings, etc.). During operation, exhaust from an internal combustion engine drives a turbocharger's turbine wheel, which, in turn, drives the compressor wheel to boost charge air to the internal combustion engine.

During operation, a turbocharger's rotating group must operate through a wide range of speeds. Depending on the size of the turbocharger, the maximum speed reached may be in excess of 200,000 rpm. Because of the wide operating range and the inherent design of the rotating group, most turbocharger rotating groups fit the definition of a "flexible rotor". Flexible rotors require a unique balancing process to assure that residual unbalance in all balance planes are controlled and results verified with a test of the unbalance response throughout the operating range. A well balanced turbocharger rotating group is essential for proper rotordynamic performance. Efforts to achieve low levels of unbalance help to assure shaft stability and minimize rotor deflection which in turn acts to reduce bearing loads. Reduced bearing loads result in improved durability and reduced noise (e.g., as resulting from transmitted vibration).

To reduce vibration, turbocharger rotating group balancing includes component and assembly balancing. Individual components such as the compressor and turbine wheel assembly are typically balanced using a low rotational speed process while assembly (e.g., the completely assembled rotating group) are typically balanced using a high speed balancing process. Normally, the balance quality of the assembly is improved with a correction made on the compressor end of the rotating group alone.

Compressor wheel designs may be of two main types, those with a through bore and those without a through bore, which are referred to as "boreless". For a compressor wheel with a through bore, the assembly process includes inserting a shaft in through the bore of the wheel and fixing the wheel to the shaft with a lock nut. The assembly is then installed in a high speed balancing machine for measurement and correction. The high speed balancer provides a means to operate the rotating group at the high speeds needed to provide adequate measurement and correction. Unbalance can be measured using instrumentation such as an accelerometer to provide an indication of unbalance in terms of vibration, or g's. In addition to the vibration response magnitude, the information provided by the high speed balancer can guide an operator, for example, by indicating where to remove material from the lock nut (e.g., phase angle of unbalance) to improve the balance. To measure unbalance phase, a high speed balancer may rely on a magnetic field sensor or an optical sensor. For a magnetic field sensor, the lock nut is magnetized (i.e., made of a magentizable material) whereas, for an optical sensor, one or more markings made on the lock nut or wheel may suffice. The magnetic method is generally preferred as being more accurate and reliable than the optical method.

For conventional boreless compressor wheels, unfortunately, the aforementioned magnetized lock nut approach to balancing does not apply. Boreless compressor wheels are often used for applications where high compressor wheel stresses make it beneficial to eliminate the bore through the wheel to reduce stress at the center of the wheel, which can be a source of failure at high rotational speeds. To balance a boreless compressor wheel, as other types of wheels, material must be removed. However, the only option for a boreless compressor wheel is to remove the material directly from the wheel itself. Accordingly, problems can arise when, after removal of some material, further balancing is required. For example, if during a final rotating group balancing operation, an acceptable balance cannot be achieved by further removal of material, the compressor wheel must be scrapped. Specifically, a nose of a boreless compressor wheel can often handle only a single balance cut and cannot be cut again.

Further, conventional boreless compressor wheels are typically made of aluminum, which is not a magentizable material. Accordingly, a magnetic field sensing approach to measuring unbalance cannot be used, which is unfortunate because, as mentioned, balancing approaches that use magnetization tend to be more efficient than optical approaches.

Various technologies described herein pertain to compressor wheels and nose pieces that can enhance balancing and, consequently, reduced rotating group vibration.

BRIEF DESCRIPTION OF THE DRAWINGS

A more complete understanding of the various methods, devices, assemblies, systems, arrangements, etc., described herein, and equivalents thereof, may be had by reference to the following detailed description when taken in conjunction with examples shown in the accompanying drawings where.

DETAILED DESCRIPTION

Figure 1:
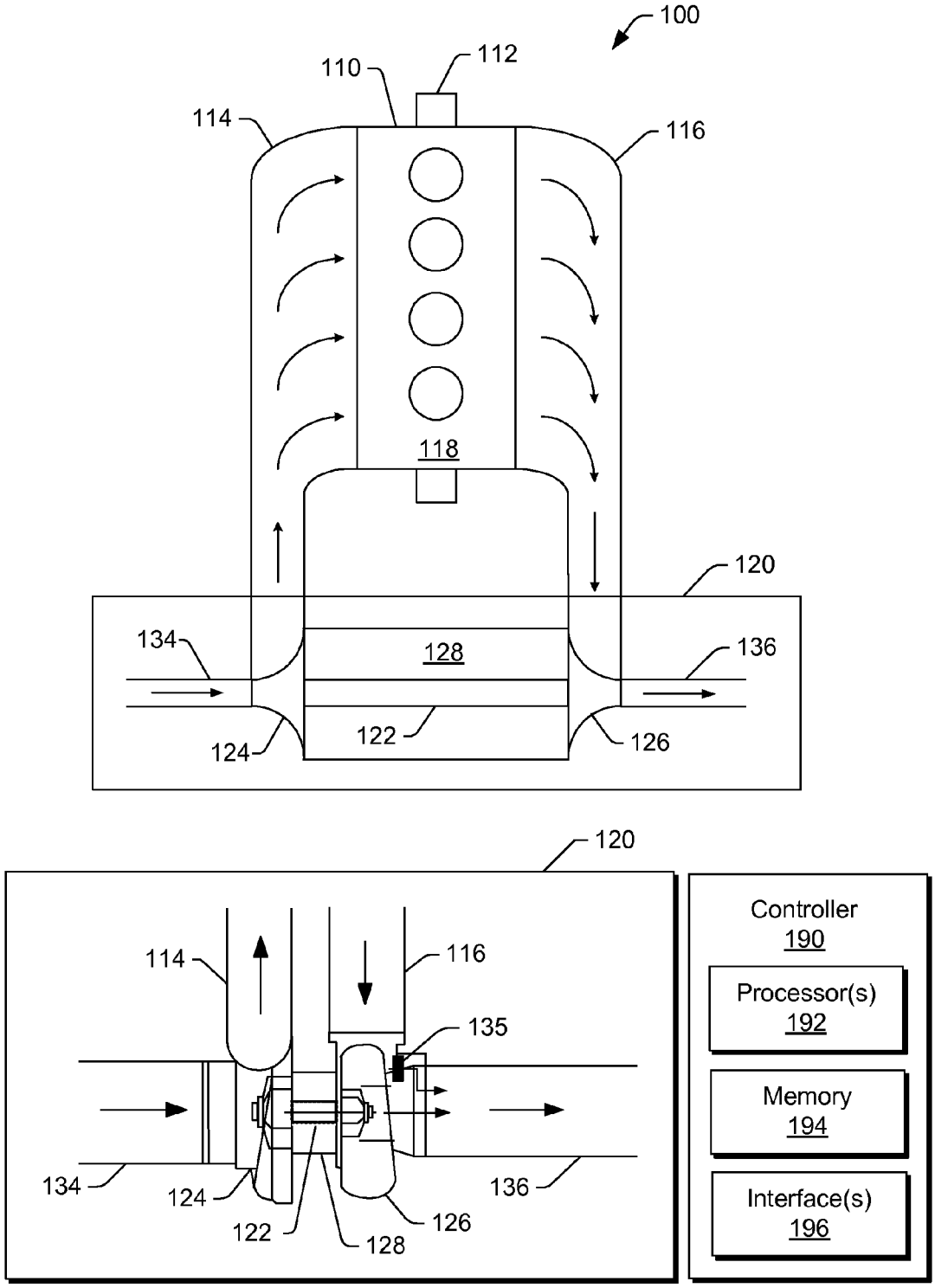
FIG. 1 is a diagram of a turbocharger and an internal combustion engine along with a controller.

Various components and assemblies are described herein. For example, components include nose pieces and boreless compressor wheels configured to receive such nose pieces. As described herein, an assembly can include a nose piece and a boreless compressor wheel that includes a nose end configured for receipt of the nose piece and a receptacle at a base end configured for receipt of a rotatable shaft. Such a shaft may be a turbocharger shaft or other rotatable shaft (e.g., driven by a belt, a chain, electric motor, etc.). Accordingly, a boreless compressor wheel with a nose piece or balanced using a nose piece may be used for turbocharger, supercharger or other applications.

As described herein, a nose piece may facilitate balancing. For example, a nose piece may be made of a magnetizable material that allows for measuring unbalance via a magnetic field sensor. As another example, optionally additional to the foregoing example, material may be removed from a nose piece to improve balance (e.g., based on measured unbalance). Accordingly, a nose piece may facilitate measurement of unbalance, balancing or measurement of unbalance and balancing. Further, a nose piece may be optionally replaceable for any of a variety of purposes or reasons.

In various examples, a boreless compressor wheel can be one in which there is a single compressor wheel or one that includes two compressor impellers or faces. For example, a wheel with two compressor impellers (e.g., mounted in a back to back fashion) may be operated in parallel or in series. In other words, each impeller face may be directed to a dedicated diffuser section, a dedicated volute, a shared diffuser section, a shared volute, etc.

In various examples, a nose piece includes a stem and a nose end of a boreless compressor wheel includes a receptacle configured to receive the stem. In an alternative example, a nose piece can include an opening and a nose end of a boreless compressor wheel can include a stem configured for insertion into the opening of the nose piece.

As described herein, a nose piece may be attached to a boreless compressor wheel by any of a variety of mechanisms. For example, features of a boreless compressor wheel and a nose piece may be configured for press fitting the nose piece on to the boreless compressor wheel, a boreless compressor wheel and a nose piece may include cooperative threads for threading the nose piece on to the boreless compressor wheel, or a nose piece may be configured to shrink fit on to a boreless compressor wheel (e.g., heated to expand and then cooled to shrink fit).

Whether for purposes of attachment or for rotation of an assembly, a nose piece may include an internal drive, an external drive or both an internal drive and an external drive, for example, where such drives are configured to cooperate with a tool or tools.

As described herein, an assembly can include a boreless compressor wheel that includes a nose piece with one or more balance cuts (e.g., to provide for balance of the assembly) and a receptacle configured for receipt of a shaft; and a turbine wheel that includes a shaft having an end received by the receptacle of the boreless compressor wheel. Such an assembly may include a nose piece made of a magnetizable material.

As described herein, a method can include fitting a nose piece to a boreless compressor wheel, measuring unbalance, and, based in part on the measuring, removing material from the nose piece. A method may include removing a nose piece from a boreless compressor wheel and fitting another nose piece to the boreless compressor wheel. With respect to measuring unbalance, various techniques may be used, for example, consider a technique that includes rotating a boreless compressor wheel and a nose piece and measuring magnetic field properties associated with the nose piece. As described herein, a method can include assembling a turbocharger that includes a boreless compressor wheel and a nose piece having at least some material removed.

Below, an example of a turbocharged engine system is described followed by various examples of components, assemblies, methods, etc.

Turbochargers are frequently utilized to increase output of an internal combustion engine. Referring to FIG. 1, a conventional system 100 includes an internal combustion engine 110 and a turbocharger 120. The internal combustion engine 110 includes an engine block 118 housing one or more combustion chambers that operatively drive a shaft 112 (e.g., via pistons). As shown in FIG. 1, an intake port 114 provides a flow path for air to the engine block 118 while an exhaust port 116 provides a flow path for exhaust from the engine block 118.

The turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor 124, a turbine 126, a housing 128 and an exhaust outlet 136. The housing 128 may be referred to as a center housing as it is disposed between the compressor 124 and the turbine 126. The shaft 122 may be a shaft assembly that includes a variety of components. In the example of FIG. 1, a wastegate valve (or simply wastegate) 135 is positioned proximate to the inlet of the turbine 126. The wastegate valve 135 can be controlled to allow exhaust from the exhaust port 116 to bypass the turbine 126.

In FIG. 1, an example of a controller 190 is shown as including one or more processors 192, memory 194 and one or more interfaces 196. Such a controller may include circuitry such as circuitry of an engine control unit. As described herein, various methods or techniques may optionally be implemented in conjunction with a controller, for example, through control logic. Control logic may depend on one or more engine operating conditions (e.g., turbo rpm, engine rpm, temperature, load, lubricant, cooling, etc.). For example, sensors may transmit information to the controller 190 via the one or more interfaces 196. Control logic may rely on such information and, in turn, the controller 190 may output control signals to control engine operation. The controller 190 may be configured to control lubricant flow, temperature, a variable geometry assembly (e.g., variable geometry compressor or turbine), a wastegate, an electric motor, or one or more other components associated with an engine, a turbocharger (or turbochargers), etc. More generally, as described herein, a controller may be configured for use in another process such as a balancing process.

Figure 2:
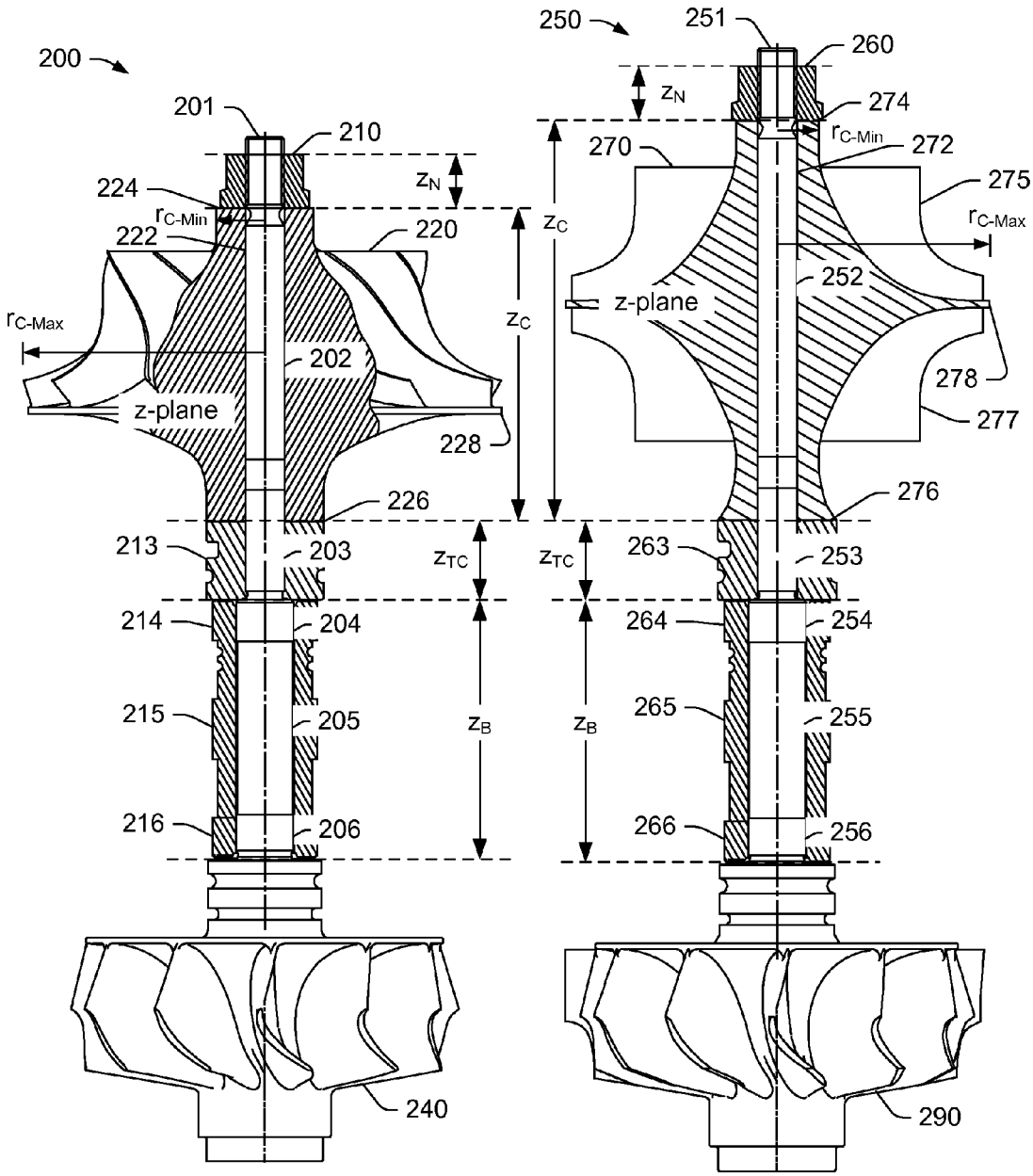
Prior Art Fig. 2
FIG. 2 is two side views of conventional assemblies where each of the assemblies includes a compressor wheel having a through bore and a lock nut fixed to a shaft that extends through the through bore.

FIG. 2 shows examples of two conventional assemblies 200 and 250 where each of the assemblies includes a compressor wheel 220 or 270 having a through bore 222 or 272 and a lock nut 210 or 260 fixed to a shaft 201 or 251 that extends through the through bore 222 or 272. As shown, the compressor wheel 270 includes two impeller faces 275 and 277 while the compressor wheel 220 includes only a single impeller face.

In the examples of FIG. 2, each of the shafts 201 and 251 extends from a respective turbine wheel 260 and 290. Disposed axially along each of the shafts 201 and 251 are respective thrust collars 213 and 263 and respective bearings 215 and 265. The shaft 201 includes a compressor wheel portion 202, a thrust collar portion 203, a compressor journal bearing portion 204, a bearing portion 205, and a turbine journal bearing portion 206. The shaft 251 also includes a compressor wheel portion 252, a thrust collar portion 253, a compressor journal bearing portion 254, a bearing portion 255, and a turbine journal bearing portion 256. Various axial dimensions are shown for the bearings 215 and 265 ($z_B$), the thrust collars 213 and 263 ($z_B$), the compressor wheels 220 and 270 ($z_C$), and the lock nuts 210 and 260 ($z_N$).

For the assembly 200, the compressor wheel 220 includes a nose end 224 that abuts the lock nut 210 and a base end 226 that abuts the thrust collar 213. The compressor wheel 220 has a minimum radius $r_{C\text{-}Min}$ at its nose end 224 and has a maximum wheel radius $r_{C\text{-}Max}$ at an edge 228 that coincides with a so-called z-plane.

For the assembly 250, the compressor wheel 270 includes a nose end 274 that abuts the lock nut 260 and a base end 276 that abuts the thrust collar 263. The compressor wheel 270 has a minimum radius $r_{C\text{-}Min}$ at its nose end 274 and has a maximum wheel radius $r_{C\text{-}Max}$ at an edge 278 that coincides with a so-called z-plane.

With respect to balancing, a lock nut is typically made of steel and suitable measuring unbalance through magnetic field sensing. During a balancing process, one or more cuts may be made in a lock nut according to information provided by a balancing machine (e.g., a VSR).

Figure 3:
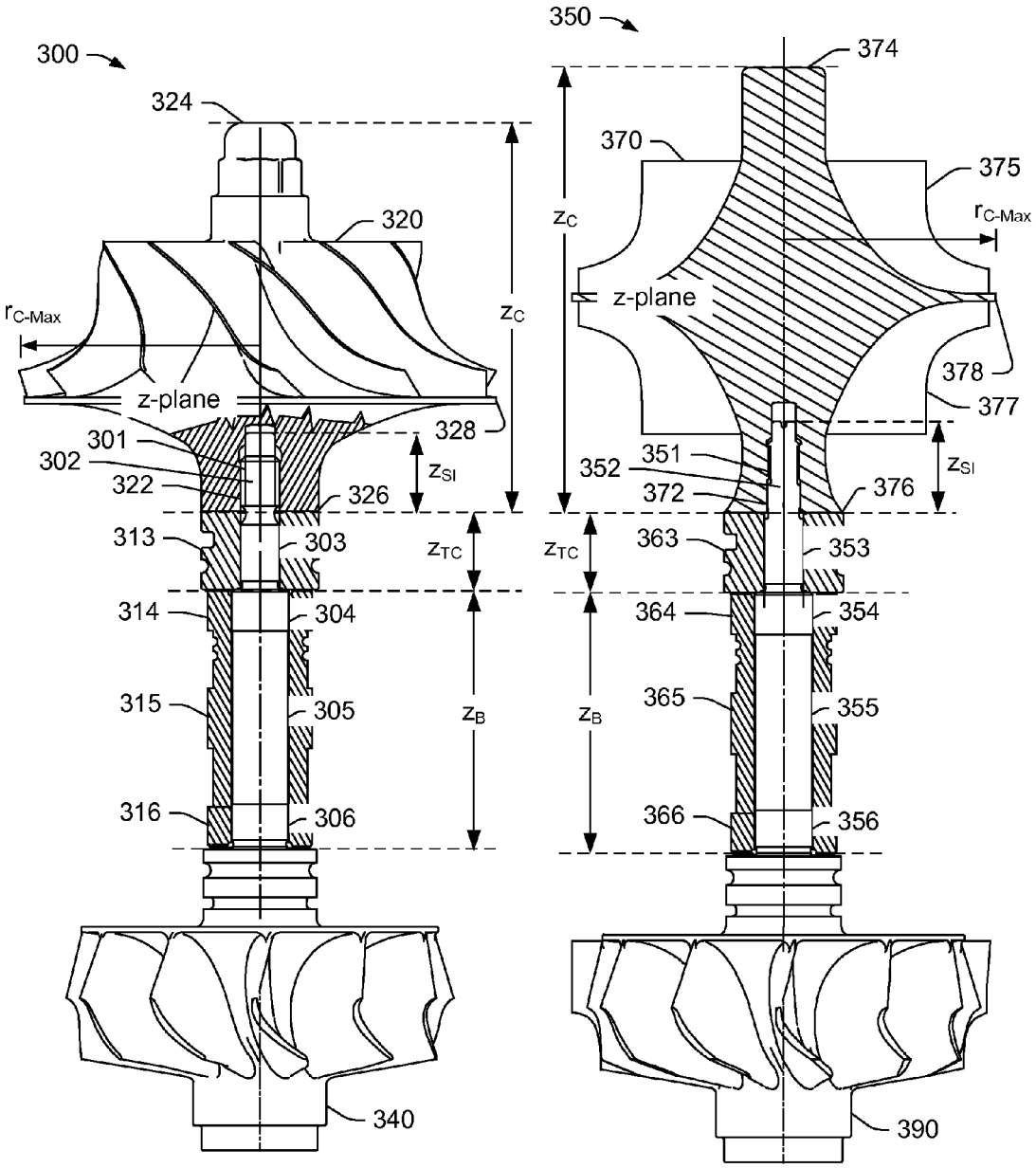
Prior Art Fig. 3
FIG. 3 is two side views of conventional assemblies where each of the assemblies includes a boreless compressor wheel having a receptacle in receipt of an end of a shaft.

FIG. 3 shows examples of two conventional assemblies 300 and 350 where each of the assemblies includes a boreless compressor wheel 320 or 370 having a receptacle 322 or 372 that receives a shaft 301 or 351. As shown, the compressor wheel 370 includes two impeller faces 375 and 377 while the compressor wheel 320 includes only a single impeller face.

In the examples of FIG. 3, each of the shafts 301 and 351 extends from a respective turbine wheel 360 and 390. Disposed axially along each of the shafts 301 and 351 are respective thrust collars 313 and 363 and respective bearings 315 and 365. The shaft 301 includes a compressor wheel portion 302, a thrust collar portion 303, a compressor journal bearing portion 304, a bearing portion 305, and a turbine journal bearing portion 306. The shaft 351 also includes a compressor wheel portion 352, a thrust collar portion 353, a compressor journal bearing portion 354, a bearing portion 355, and a turbine journal bearing portion 356. Various axial dimensions are shown for the bearings 315 and 365 ($z_B$), the thrust collars 313 and 363 ($z_B$), the compressor wheels 320 and 370 ($z_C$), and the insertion depth of the portions 302 and 352 of the shafts 301 and 351 in their respective receptacles 322 and 352 ($z_{SI}$).

For the assembly 300, the compressor wheel 320 includes a nose end 324 and a base end 326 that abuts the thrust collar 313. The compressor wheel 320 has a maximum wheel radius $r_{C\text{-}Max}$ at an edge 328 that coincides with a so-called z-plane.

For the assembly 350, the compressor wheel 370 includes a nose end 374 and a base end 376 that abuts the thrust collar 363. The compressor wheel 370 has a maximum wheel radius $r_{C\text{-}Max}$ at an edge 378 that coincides with a so-called z-plane.

With respect to balancing, one or more markings are typically made on a boreless compressor wheel followed by measuring unbalance through optical sensing of such marking or markings. During a balancing process, one or more cuts may be made in a nose end of a boreless compressor wheel according to information provided by a balancing machine (e.g., a VSR).

Figure 4:
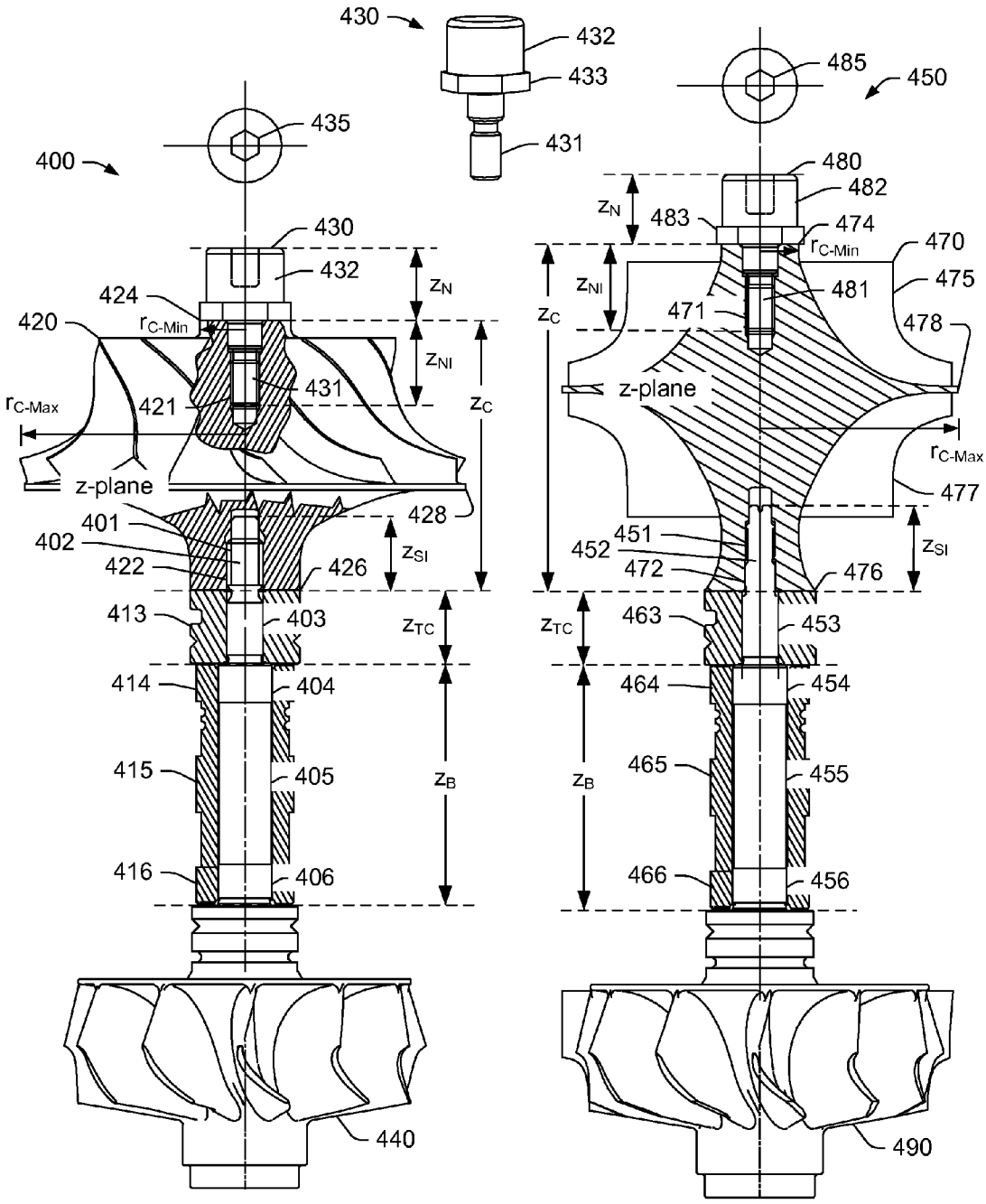
FIG. 4 is a series of views of an example of a nose piece and examples of assemblies where each of the assemblies includes a boreless compressor wheel having a receptacle in receipt of a nose piece and another receptacle in receipt of an end of a shaft.

FIG. 4 shows examples of assemblies 400 and 450 where each of the assemblies includes a boreless compressor wheel 420 and 470 where each of the boreless compressor wheels 420 and 470 has a receptacle 421 and 471 in receipt of a respective nose piece 430 and 480 and another receptacle 422 and 472 in receipt of an end 402 and 452 of a respective shaft 401 and 451. As shown, the compressor wheel 470 includes two impeller faces 475 and 477 while the compressor wheel 420 includes only a single impeller face.

In the examples of FIG. 4, each of the shafts 401 and 451 extends from a respective turbine wheel 460 and 490. Disposed axially along each of the shafts 401 and 451 are respective thrust collars 413 and 463 and respective bearings 415 and 465. The shaft 401 includes a compressor wheel portion 402, a thrust collar portion 403, a compressor journal bearing portion 404, a bearing portion 405, and a turbine journal bearing portion 406. The shaft 451 also includes a compressor wheel portion 452, a thrust collar portion 453, a compressor journal bearing portion 454, a bearing portion 455, and a turbine journal bearing portion 456. Various axial dimensions are shown for the bearings 415 and 465 ($z_B$), the thrust collars 413 and 463 ($z_B$), the compressor wheels 420 and 470 ($z_C$), the insertion depth of the portions 402 and 452 of the shafts 401 and 451 in their respective receptacles 422 and 452 ($z_{SI}$), the insertion depth of stems 431 and 481 of the nose pieces 430 and 480 in their respective receptacles 421 and 471 ($z_{NI}$), and for the nose pieces 430 and 480 ($Z_N$).

For the assembly 400, the compressor wheel 420 includes a nose end 424 that abuts the nose piece 430 and a base end 426 that abuts the thrust collar 413. The compressor wheel 420 has a minimum wheel radius $r_{C\text{-}Min}$ at the nose end 424 and a maximum wheel radius $r_{C\text{-}Max}$ at an edge 428 that coincides with a so-called z-plane.

For the assembly 450, the compressor wheel 470 includes a nose end 474 that abuts the nose piece 480 and a base end 476 that abuts the thrust collar 463. The compressor wheel 470 has a minimum wheel radius $r_{C\text{-}Min}$ at the nose end 474 and a maximum wheel radius $r_{C\text{-}Max}$ at an edge 478 that coincides with a so-called z-plane.

FIG. 4 also shows top views of the nose pieces 430 and 480, which illustrate optional internal drives 435 and 485. A perspective view shows the nose piece 430 as including an optional external drive disposed between a head portion 432 and the stem 431. In the example of FIG. 4, the nose piece 480 is also shown as including an optional external drive 483 disposed between a head portion 482 and a stem portion 481. Such drives can allow for rotation of at least a nose piece, for example, to attach a nose piece to a boreless compressor wheel or, for example, to rotate a nose piece and boreless compressor wheel as an assembly.

With respect to balancing, a nose piece can allow for measurement of unbalance, balancing or measurement of unbalance and balancing. With respect to balancing, during a balancing process, one or more cuts may be made in a nose piece attached to a boreless compressor wheel according to information provided by a balancing machine (e.g., a VSR). As described herein, a nose piece may be made of steel, aluminum or another material.

Figure 5:
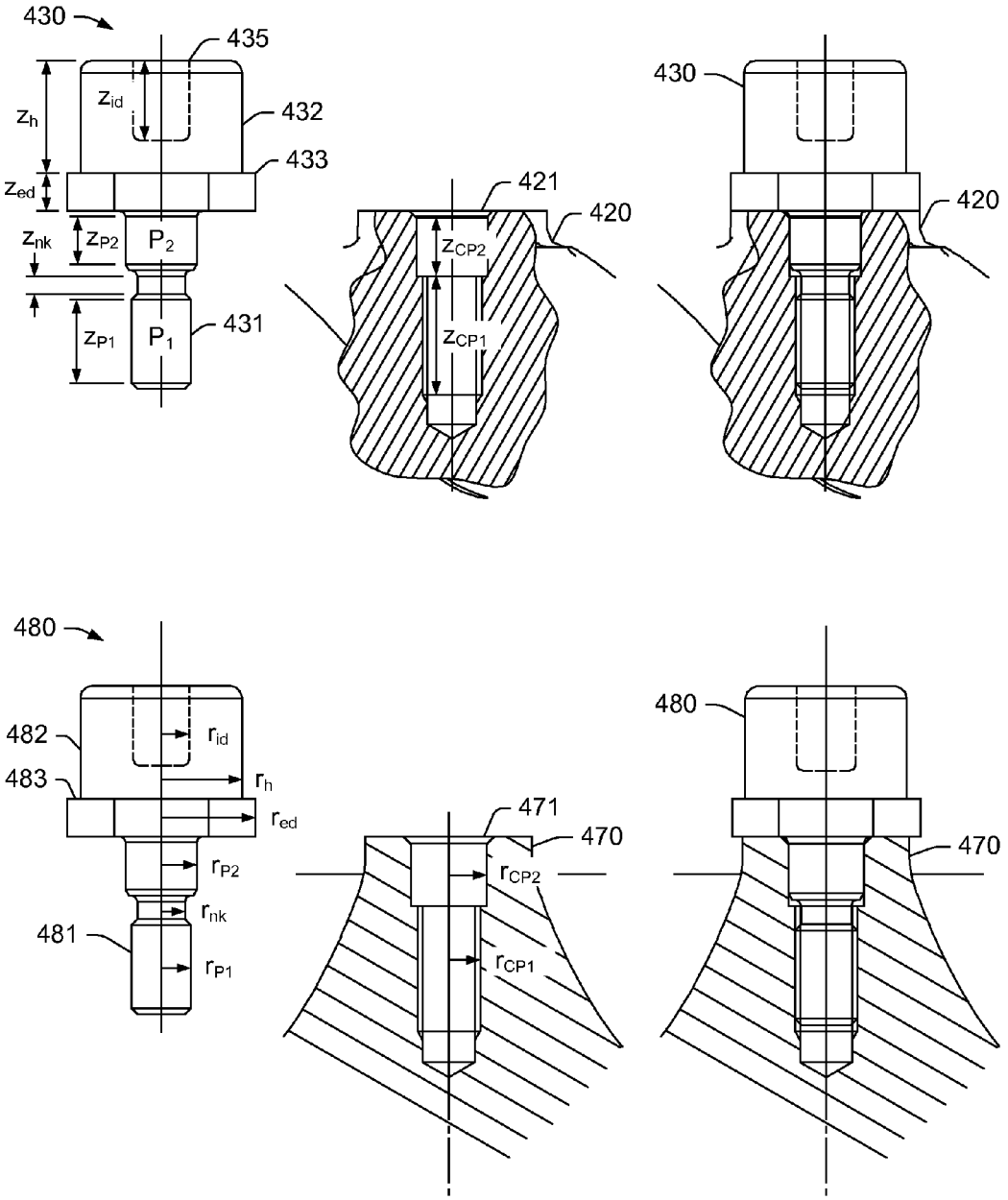
FIG. 5 is a series of views of the nose pieces and the boreless compressor wheel receptacles of FIG. 4.

FIG. 5 shows various views of the nose pieces 430 and 480 and the boreless compressor wheel receptacles 421 and 471 of the examples of FIG. 4. The nose pieces 430 and 480 may include common features. For example, the nose pieces 430 and 480 may include one or more pilot surfaces along their respective stems 431 and 481. A pilot surface is typically disposed at a radius extending over an axial length. The nose pieces 430 and 480 include two pilot surfaces $P_1$ and $P_2$ disposed at respective radii $r_{P1}$ and $r_{P2}$ and extending over respective axial lengths $Z_{P1}$ and $Z_{P2}$. As shown in the example of FIG. 5, a neck is disposed between the pilot surfaces P1 and P2, which has a radius $r_{nk}$ and an axial length $z_{nk}$. Other dimensions of the nose pieces 430 and 480 shown in FIG. 5 include an axial head length ($z_h$) and a head radius ($r_h$), an axial external drive length ($z_{ed}$) and an external drive radius ($r_{ed}$), and an axial internal drive length ($z_{id}$) and an internal drive radius ($r_{id}$). In general, a nose piece has a head portion of sufficient mass such that removal of some of the mass (e.g., via cutting or other technique) can improve balance of nose piece and boreless wheel assembly.

As described herein, various features of a nose piece may cooperate with one or more features of a boreless compressor wheel receptacle. For example, the receptacle 421 of the boreless compressor wheel 420 and the receptacle 471 of the boreless compressor wheel 470 may include a surface with an axial length $Z_{CP1}$ and a radius $r_{CP1}$ and a surface with an axial length $z_{CP2}$ and a radius $r_{CP2}$ where such surfaces cooperate with a pilot surface of a portion of a nose piece such as the pilot surfaces $P_1$ and $P_2$ of the nose pieces 430 and 480. As shown in FIG. 4, the receptacles 420 and 471 do not extend axially to the z-plane. Further, in the examples of FIG. 4, the receptacles 422 and 472 do not extend axially to the z-plane. Accordingly, the boreless wheel 420 or the boreless wheel 470 may optionally be characterized as including two axially aligned and opposing receptacles that do not extend to a z-plane of a wheel. Hence, as shown in FIG. 4, such a wheel has a solid portion (i.e., boreless portion) located axially between the two opposing receptacles. As described herein, a receptacle may be shaped at a distal end (e.g., closed end) to reduce stress.

As described herein, a portion of a nose piece may include threads while a portion of a boreless compressor wheel includes cooperating threads. Accordingly, a nose piece may be rotated with respect to a boreless compressor wheel to secure the nose piece to the wheel. Other mechanisms for attachment may include bayonet, press fit via appropriate clearances, etc. As described herein, a pilot surface or other feature may help align a nose piece along a rotational axis of a boreless compressor wheel.

Figure 6:
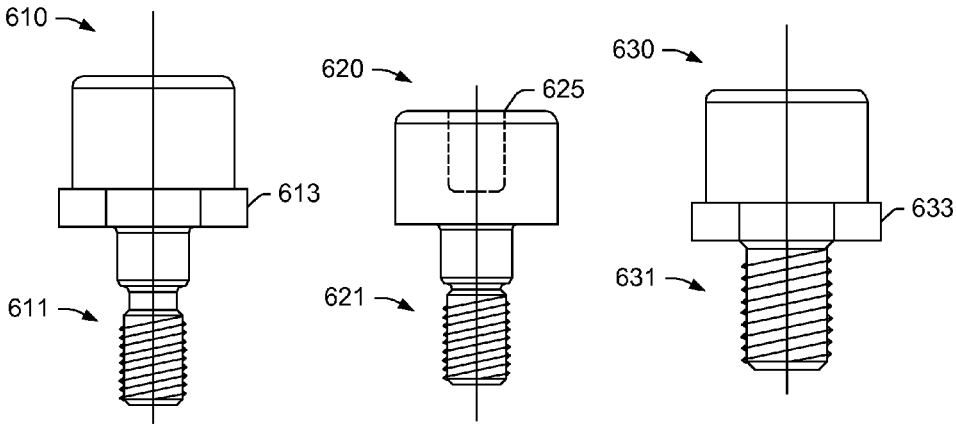
FIG. 6 is a series of views of examples of nose pieces and examples of cuts for removal of material from a nose piece.
Figure 6:
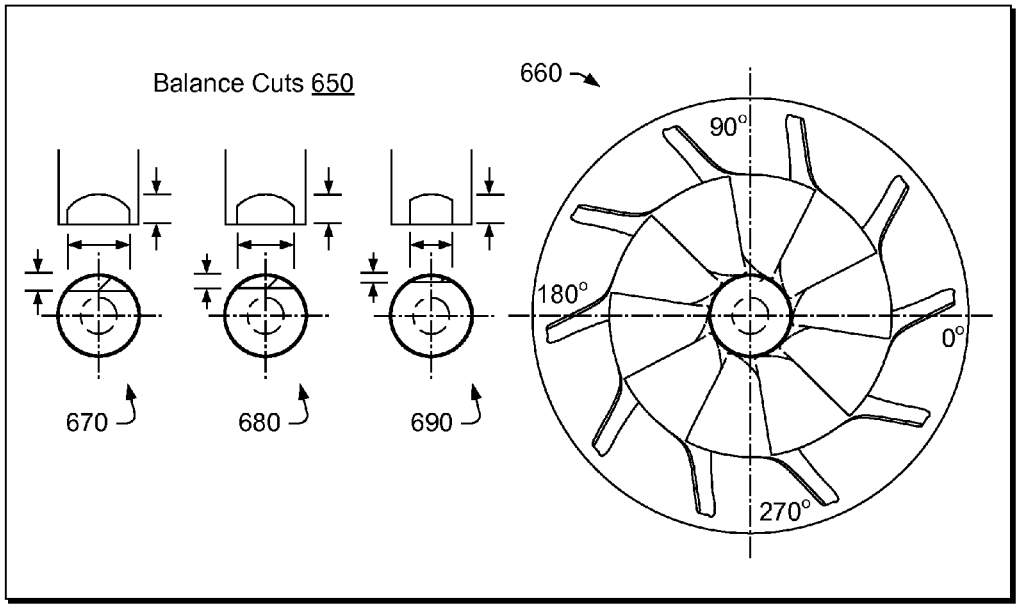

FIG. 6 shows some examples of nose pieces 610, 620 and 630 and examples of cuts for removal of material from a nose piece 650. As shown in FIG. 6, the nose piece 610 includes a threaded stem 611 and an external drive 613. As described herein, a tool such as a wrench may engage the external drive 613 to rotate the nose piece 610 with respect to a boreless compressor wheel to thereby secure the nose piece 610 to the boreless compressor wheel. Once secured, the external drive 613 may allow for rotation of the nose piece 610 and the boreless compress wheel as a unit.

As shown in FIG. 6, the nose piece 620 includes a threaded stem 621 and an internal drive 625. As described herein, a tool such as a hex wrench may engage the internal drive 625 to rotate the nose piece 620 with respect to a boreless compressor wheel to thereby secure the nose piece 620 to the boreless compressor wheel. Once secured, the internal drive 625 may allow for rotation of the nose piece 620 and the boreless compress wheel as a unit.

As shown in FIG. 6, the nose piece 630 includes a threaded stem 631 without any pilot surfaces and an external drive 633. As described herein, a tool such as a wrench may engage the external drive 633 to rotate the nose piece 630 with respect to a boreless compressor wheel to thereby secure the nose piece 630 to the boreless compressor wheel. Once secured, the external drive 633 may allow for rotation of the nose piece 630 and the boreless compress wheel as a unit.

As described herein, should removal of a nose piece from a boreless compressor wheel be desired or required, a drive or drives may be suitable used in conjunction with an appropriate tool or tools to remove the nose piece. For example, the drives 613, 625 and 633 of the nose pieces 610, 620 and 630 may be used for installation and removal. While the examples of FIG. 6 show threads, as described herein, other mechanisms may be used to secure a nose piece to a boreless compressor wheel.

FIG. 6 also shows various balance cuts 650 with respect to a nose piece 670, a nose piece 680 and a nose piece 690, which may be fitted to a boreless compressor wheel 660. As shown, the cuts may be made from an end of a nose piece and extend axially downward. In such a manner, material can be removed to improve balance. As described herein, phase information may guide an operator as to angle of a cut. While all of the cuts 650 are shown as being aligned (e.g., centered at 90 degrees), a cut may be aligned at any angle about a nose piece and made in any manner or shape.

Figure 7:
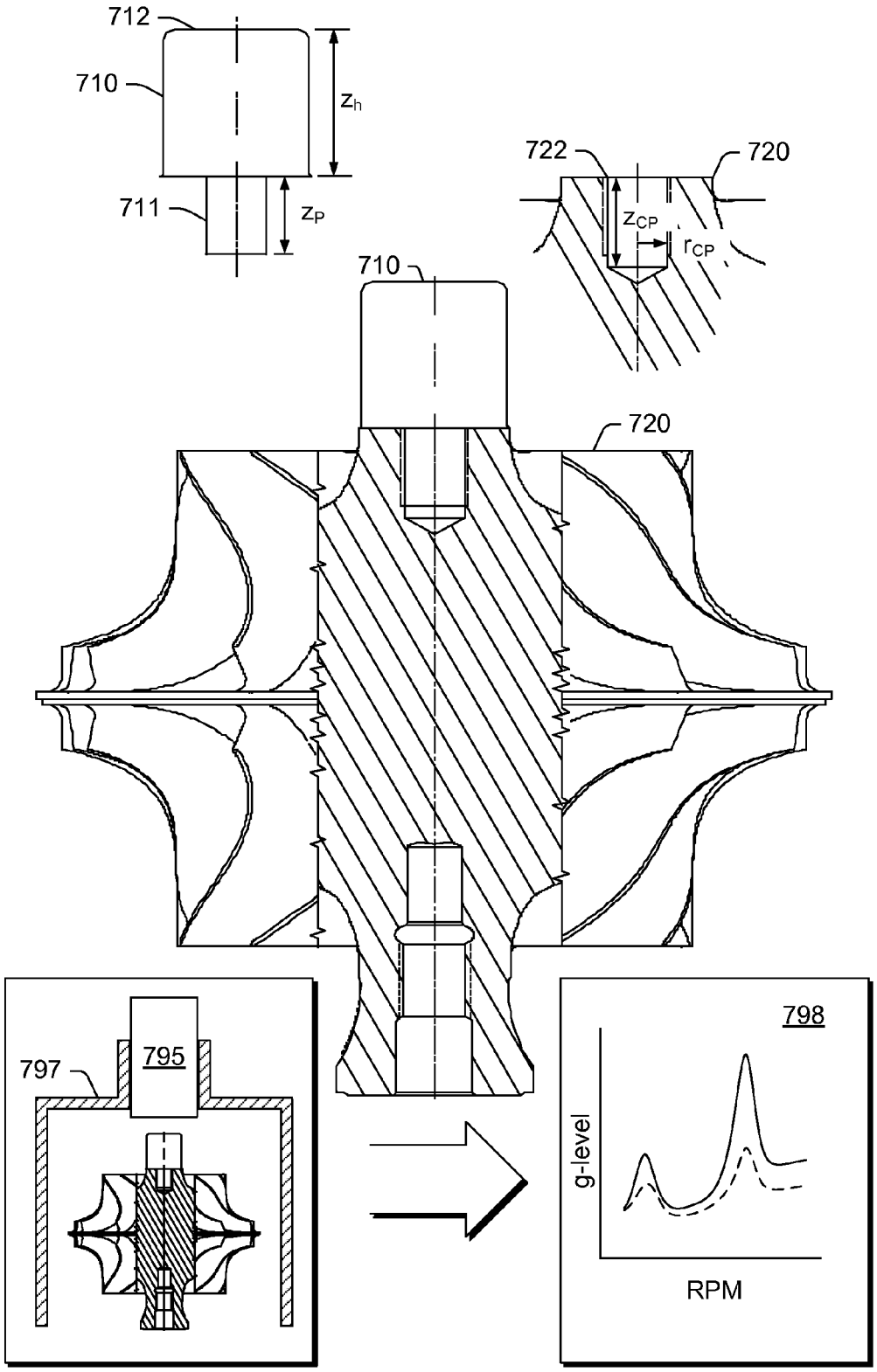
FIG. 7 is a series of views of an example of a nose piece and a boreless compressor wheel along with a diagram of balancing equipment and a plot of measured unbalance versus rotational speed.

FIG. 7 shows an example of a nose piece 710 and a boreless compressor wheel 720 along with balancing equipment 795 and 797 and a plot 798 of measured unbalance versus rotational speed. In the example of FIG. 7, the nose piece includes a stem 711 and a head 712 while the boreless compressor wheel 720 includes a receptacle 722 with an axial length $z_{CP}$ and a radius $r_{CP}$. Accordingly, the nose piece 710 may be fitted to the boreless compressor wheel 720 by inserting the stem 711 into the receptacle 722. As described herein, a nose piece may be attached to a boreless compressor wheel via any of a variety of mechanisms, such as, for example, threads, press fit, etc.

In the example of FIG. 7, the nose piece 710 is made of a magnetizable material such as steel. In preparation for measurement of unbalance, the nose piece 710 may be magnetized, for example, magnetizing may occur by passing a magnet closely by the nose piece 710. For measuring unbalance, the nose piece 710 as affixed to the boreless compressor wheel 720 may be placed in a shroud 797 and rotated such that a magnetic field sensor 795 can measure unbalance. In turn, such information may be plotted as shown in the plot 798 as g-level versus rpm. The plot 798 shows a solid line that represents unbalance prior to removal of material from the nose piece 710, the boreless compressor wheel 720 or from the nose piece 710 and the boreless compressor wheel 720 as well as a dashed line that represents a reduced g-level (or vibration unbalance) after removal of material. As described herein, a nose piece made from or including a magnetizable material can allow for magnetic field-based measurement of unbalance of a boreless compressor wheel made of a non-magnetizable material. Further, such a nose piece can allow for alteration of a center of mass of an assembly to improve balance (e.g., by removal of material via a cut or other technique).

Figure 8:
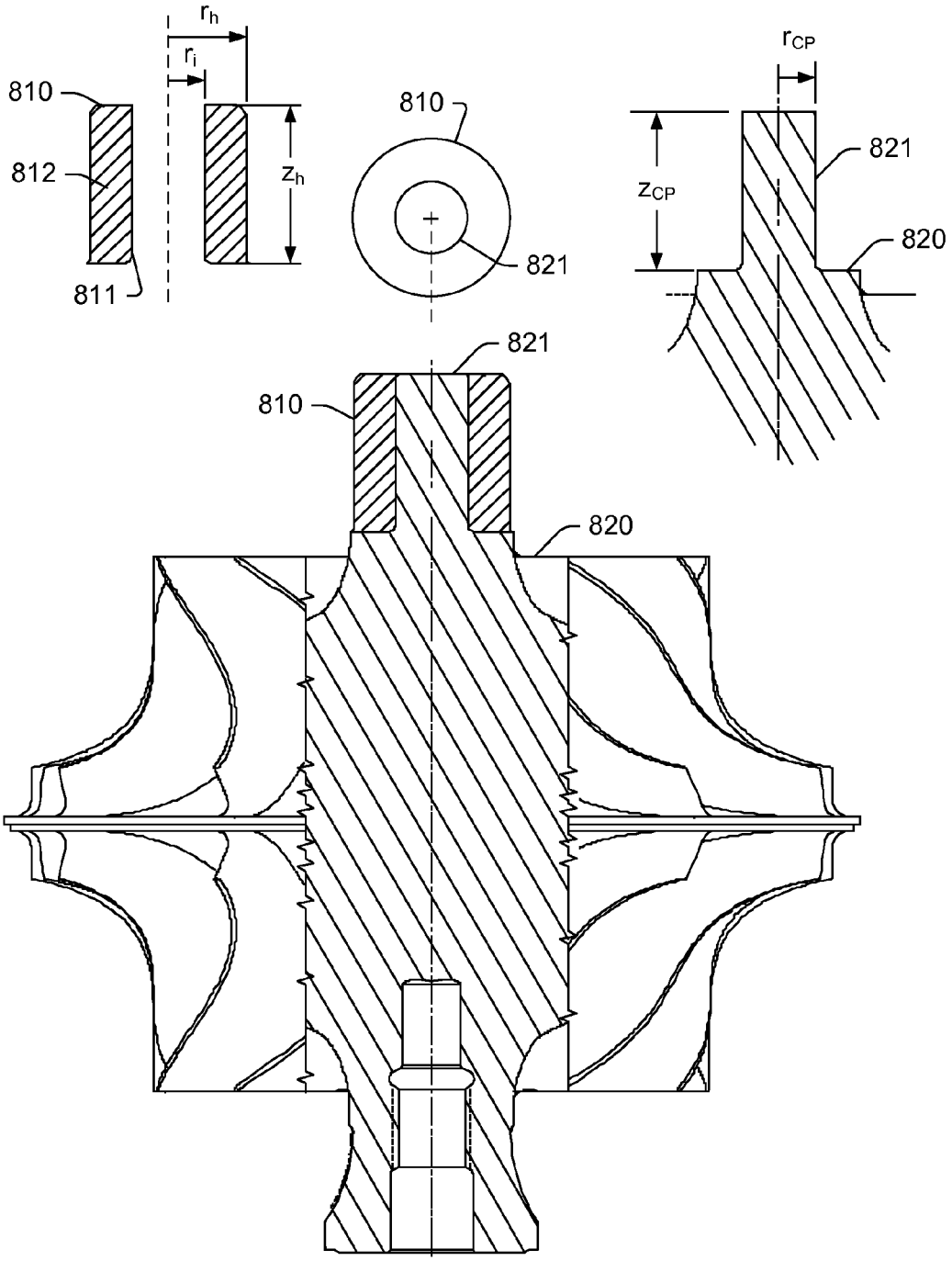
FIG. 8 is a series of views of an example of a nose piece and a boreless compressor wheel.

FIG. 8 shows an example of a nose piece 810 and a boreless compressor wheel 820. Such a nose piece may be for purposes of sensing unbalance using a magnetic field sensor, for purposes of material removal to improve balance or a combination of both sensing and material removal to improve balance. In the example of FIG. 8, the nose piece 810 includes an opening 811 with a radius $r_i$ while the boreless compressor wheel 820 includes a stem portion 821 with a radius $r_{CP}$. Other dimensions shown in FIG. 8 include a nose piece outer radius ($r_h$), a nose piece axial length ($z_h$) and a stem axial length ($z_{CP}$).

As shown in FIG. 8, the nose piece 810 can be received by the stem 821 of the boreless compressor wheel 820. Clearances between the opening 811 and the stem 821 may provide for a secure press fit. As another example, a nose piece may be provided that responds to heating or other processing to shrink fit securely onto the stem 821. As described herein, such a fit may be relatively permanent or allow for reversal if removal and replacement of the nose piece is desired.

Further, in the example of FIG. 8, the nose piece 810 may be made of or include a magnetizable material while the boreless compressor wheel 820 may be made of a non-magnetizable material. Where balancing requires removal of material, material may be removed from the nose piece 810, from the boreless compressor wheel 820 or from both the nose piece 810 and the boreless compressor wheel 820. Where desired, the thickness of the nose piece 810 may be sufficient to receive a cut for purposes of improving balance of a nose piece and boreless wheel assembly. As shown in FIG. 6, balance cuts 650 extend axially downward. With respect to the nose piece 810, cuts may extend axially downward a distance less than the axial length ($z_h$) of the nose piece (e.g., to maintain sufficient integrity of the nose piece).

As described herein, a nose piece may be a precision made part that is balanced and made of or including a magnetizable material. In such an example, the nose piece may be fitted to a boreless compressor wheel for purposes of measuring unbalance and then removed from the boreless compressor wheel after balancing (e.g., after removal of material from the boreless compressor wheel). In such a manner, the nose piece is temporary and does not add to complexity or weight of a finished assembly.

Figure 9:
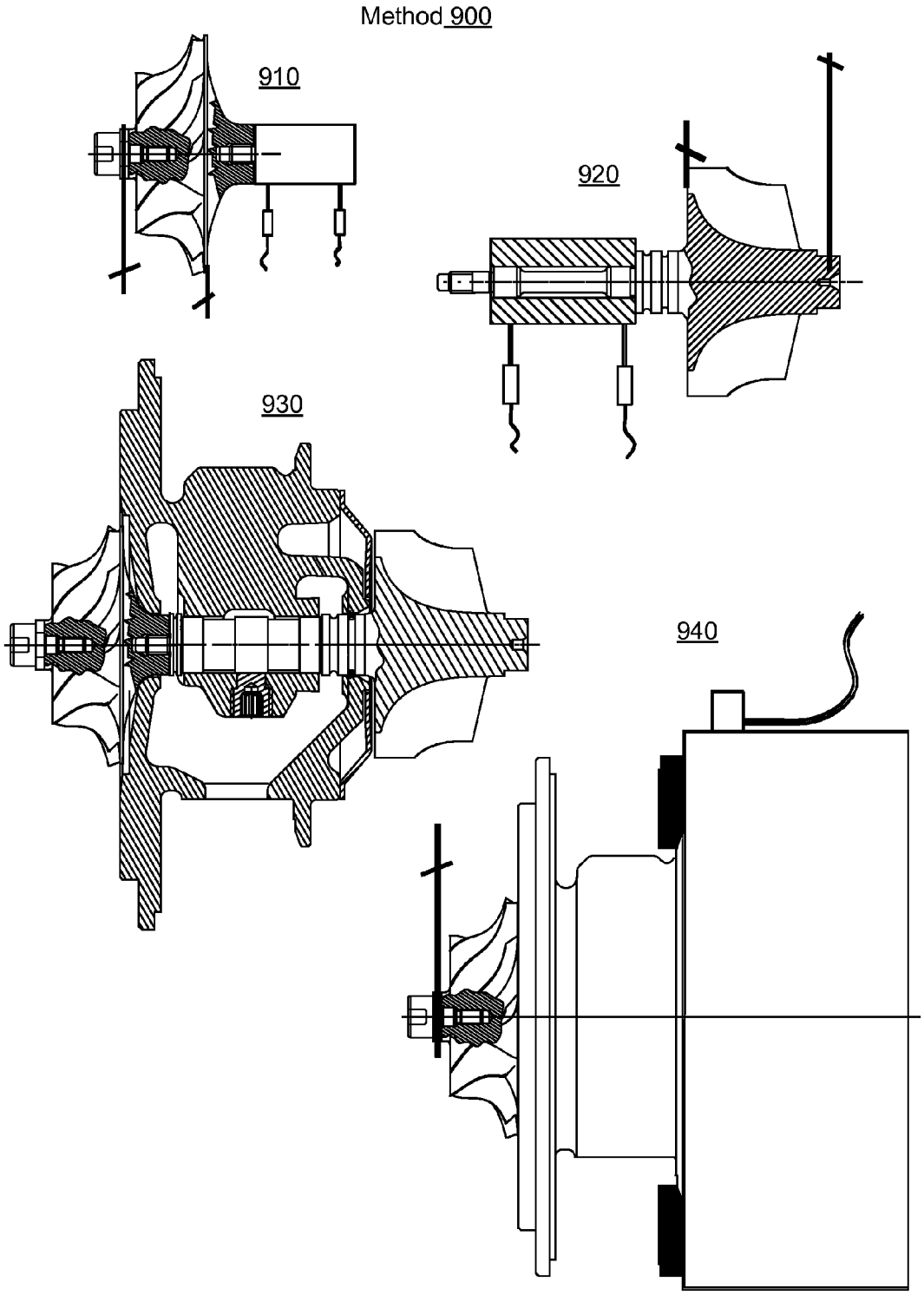
FIG. 9 is a diagram of an example of a method that includes component balancing, assembling and assembly balancing.

FIG. 9 shows an example of a method 900 that includes component balancing 910 and 920, assembling components 930 and assembly balancing 940. In the balancing process 910, a boreless compressor wheel fitted with a nose piece is balanced in two planes using sensors. In such a process, the wheel may be driven with air, for example, using a fixed air spindle inserted into a shaft receptacle of the wheel. In the balancing process 920, a shaft and turbine wheel assembly (SWA) is balanced in two planes using sensors. In such a process the SWA may be placed in a bearing and driven by air.

After component balancing, the assembly process 930 includes assembling a CHRA using the balanced components. Once assembled, the assembly balancing process 940 may allow for reduction of unbalance, optionally including so-called "stack-up" unbalance (e.g., due to arrangement of various components of the CHRA). In the assembly balancing process 940, the CHRA is fitted to a balancing machine that includes accelerometers to facilitate measurement of unbalance while driving the rotating group of the CHRA. Such a balancing machine may also rely on magnetic field sensing, as mentioned. As described herein, to correct unbalance, material is removed from the nose piece of the boreless compressor wheel. If the nose piece cannot provide for further removal of material, the nose piece may optionally be removed and the CHRA optionally disassembled followed by attachment of a new nose piece, component balancing of the new nose piece and boreless compressor wheel as a unit, assembly of the CHRA and assembly balancing.

Figure 10:
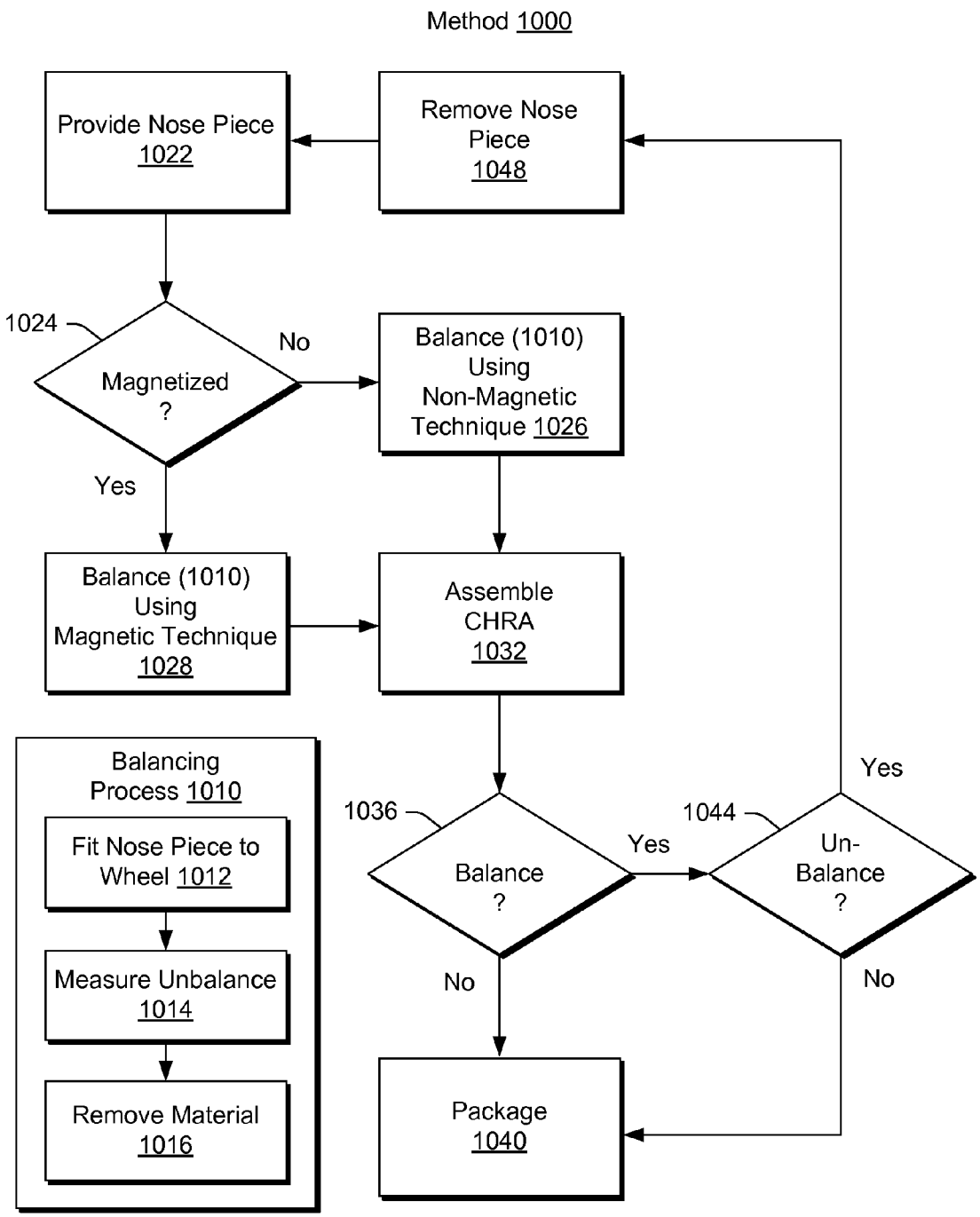
FIG. 10 is a block diagram of an example of a method that includes balancing a boreless compressor wheel that includes a nose piece.

FIG. 10 shows an example of a method 1000 for balancing a boreless compressor wheel. The method 1000 includes a balancing process 1010 that includes fitting a nose piece to a wheel 1012, measuring unbalance 1014 and removing material 1016. Such a process may be implemented by block 1028 and by block 1026.

The method 1000 commences in a provision block 1022 that includes providing a nose piece. A decision block 1024 follows that decides whether the nose piece is made of or otherwise includes a magnetizable material. If the decision block 1024 decides that the nose piece is not magnetized, then the method 1000 continues in a balance block 1026; otherwise the method 1000 continues in a balance block 1028. As mentioned, the balance block 1026 and 1028 may implement the balancing process 1010.

After balancing, which may be component balancing for a boreless compressor wheel, an assembly block 1032 includes assembling a CHRA using the boreless compressor wheel subject to the balancing of block 1026 or block 1028. As shown in the example of FIG. 10, another decision block 1036 decides whether further balancing should occur. If the decision block 1036 decides that no further balancing is to occur, the method 1000 may end in a packaging block 1040 that includes packaging the CHRA, optionally as a part of a turbocharger. However, if the decision block 1036 decides that further balancing is warranted, the method 1000 continues in yet another decision block 1044 that decides whether unbalance exists. If unbalance does not exist or is otherwise acceptable, the method 1000 continues to the packaging block 1040; otherwise, the method 1000 continues at a removal block 1048 that involves removal of the nose piece. For example, rather than scraping the boreless compressor wheel due to unacceptable unbalance, the method 1000 can provide for replacement of a nose piece with another nose piece.

Specifically, where a nose piece has been cut during a preliminary balancing process, it may be unsuited for receiving one or more additional cuts responsive to a subsequent balancing process. Accordingly, where such situations arise, a nose piece may be simply removed and replaced with another nose piece (e.g., a fresh, uncut nose piece). Such a process can reduce waste of boreless compressor wheels as material may be removed from a nose piece rather than a boreless wheel. In other words, waste can be shifted to nose pieces, which are easier to manufacture and of lesser cost than boreless compressor wheels.

As described herein, various acts may be performed by a controller (see, e.g., the controller 190 of FIG. 1), which may be a programmable control configured to operate according to instructions. As described herein, one or more computer-readable media may include processor-executable instructions to instruct a computer (e.g., controller or other computing device) to perform one or more acts described herein. A computer-readable medium may be a storage medium (e.g., a device such as a memory chip, memory card, storage disk, etc.). A controller may be able to access such a storage medium (e.g., via a wired or wireless interface) and load information (e.g., instructions and/or other information) into memory (see, e.g., the memory 194 of FIG. 1). As described herein, a controller may be an engine control unit (ECU) or other control unit (e.g., of a balancing unit).

Although some examples of methods, devices, systems, arrangements, etc., have been illustrated in the accompanying Drawings and described in the foregoing Detailed Description, it will be understood that the example embodiments disclosed are not limiting, but are capable of numerous rearrangements, modifications and substitutions without departing from the spirit set forth and defined by the following claims.

What is claimed is:

1. An assembly comprising:

a boreless compressor wheel that comprises a nose piece with one or more balance cuts and a receptacle configured for receipt of a shaft; and a turbine wheel that comprises a shaft having an end received by the receptacle of the boreless compressor wheel.

2. The assembly of claim 1 wherein the nose piece comprises a magnetizable material.

3. The assembly of claim 1 wherein the one or more balance cuts provide for balance of the assembly.

4. The assembly of claim 1 wherein the boreless compressor wheel comprises two impeller faces.

5. The assembly of claim 1 wherein the nose piece comprises a stem and wherein the nose end of the boreless compressor wheel comprises a receptacle configured to receive the stem.

6. The assembly of claim 1 wherein the nose piece comprises an opening and wherein the nose end of the boreless compressor wheel comprises a stem configured for insertion into the opening of the nose piece.

7. The assembly of claim 1 wherein the boreless compressor wheel comprises a non-magnetizable material.

8. The assembly of claim 1 wherein the nose piece comprises a replaceable nose piece.

9. The assembly of claim 1 wherein features of the boreless compressor wheel and the nose piece comprise features configured for press fitting the nose piece on to the boreless compressor wheel.

10. The assembly of claim 1 wherein the boreless compressor wheel and the nose piece comprise cooperative threads for threading the nose piece on to the boreless compressor wheel.

11. The assembly of claim 1 wherein the nose piece comprises a nose piece configured to shrink fit on to the boreless compressor wheel.

12. The assembly of claim 1 wherein the nose piece comprises an internal drive for rotating at least the nose piece.

13. The assembly of claim 1 wherein the nose piece comprises an external drive for rotating at least the nose piece.

14. The assembly of claim 1 wherein the nose piece comprises an internal drive and an external drive.

15. The assembly of claim 1 comprising a replacement nose piece.

16. A turbocharger comprising:

a boreless compressor wheel that comprises a nose piece with one or more balance cuts and a receptacle configured for receipt of a shaft; and a turbine wheel that comprises a shaft having an end received by the receptacle of the boreless compressor wheel.

17. A method comprising:

fitting a nose piece to a boreless compressor wheel;

measuring unbalance; and based in part on the measuring, removing material from the nose piece.

18. The method of claim 17 comprising removing the nose piece and fitting another nose piece to the boreless compressor wheel.

19. The method of claim 17 wherein the measuring comprises rotating the boreless compressor wheel and the nose piece and measuring magnetic field properties associated with the nose piece.

20. The method of claim 17 further comprising assembling a turbocharger that comprises the boreless compressor wheel and the nose piece having at least some material removed.

* * * * *